US007490447B2

(12) United States Patent
Ouellette et al.

(10) Patent No.: US 7,490,447 B2
(45) Date of Patent: Feb. 17, 2009

(54) SIDING TOOL

(75) Inventors: Richard D. Ouellette, Jupiter, FL (US); Thomas A. DeBono, Jupiter, FL (US)

(73) Assignee: Tropical Star, Inc., Jupiter, FL (US)

( * ) Notice: Subject to any disclaimer, the term of this patent is extended or adjusted under 35 U.S.C. 154(b) by 325 days.

(21) Appl. No.: 11/234,366

(22) Filed: Sep. 23, 2005

(65) Prior Publication Data

US 2007/0068115 A1 Mar. 29, 2007

(51) Int. Cl.
*E04D 15/00* (2006.01)

(52) U.S. Cl. ..... 52/749.1; 52/547; 33/645

(58) Field of Classification Search ..... 52/749.1, 52/749.11, 547, 749.13; 81/45, 15.9; 33/187, 33/647, 646, 648, 649, 645, 411, 613, 410
See application file for complete search history.

(56) References Cited

U.S. PATENT DOCUMENTS

| | | | | | |
|---|---|---|---|---|---|
| 327,446 | A | * | 9/1885 | Tracy | 474/157 |
| 345,261 | A | * | 7/1886 | Summit | 33/33 |
| 631,315 | A | * | 8/1899 | Meskill | 33/647 |
| 2,511,083 | A | * | 6/1950 | Small | 52/547 |
| 3,222,831 | A | * | 12/1965 | Pritchard | 52/99 |
| 3,463,480 | A | * | 8/1969 | Edstrom | 269/309 |
| 3,904,184 | A | * | 9/1975 | Krueger | 269/102 |
| 4,155,175 | A | | 5/1979 | Stiles | |
| 4,159,029 | A | | 6/1979 | Matthews | |
| 4,314,429 | A | * | 2/1982 | Casteel et al. | 52/127.2 |
| 4,473,100 | A | * | 9/1984 | Wheeler | 81/45 |
| 4,698,942 | A | * | 10/1987 | Swartz | 52/99 |
| 4,862,669 | A | | 9/1989 | Jacobsen | |
| 4,899,459 | A | * | 2/1990 | Taggart | 33/646 |
| 4,937,950 | A | * | 7/1990 | Farnworth | 33/646 |
| D334,892 | S | | 4/1993 | Jenkins | |
| 5,203,090 | A | | 4/1993 | Bouska et al. | |
| 4,425,714 | A | | 1/1994 | Kelly, Jr. | |
| 5,290,019 | A | * | 3/1994 | Beyers | 269/43 |
| 5,319,909 | A | | 6/1994 | Singleterry | |
| D362,812 | S | | 10/1995 | Meyer | |
| 5,465,499 | A | | 11/1995 | LaPlante | |
| 5,522,149 | A | | 6/1996 | Meyer | |
| 5,564,245 | A | * | 10/1996 | Rademacher | 52/520 |
| 6,494,016 | B1 | * | 12/2002 | Bankson | 52/749.1 |
| 6,848,192 | B2 | | 2/2005 | Partin | |
| 6,865,922 | B1 | | 3/2005 | Becker | |
| 6,928,743 | B1 | * | 8/2005 | Marshall | 33/648 |
| 7,124,551 | B1 | * | 10/2006 | Patera | 52/749.1 |
| 7,134,253 | B2 | * | 11/2006 | Edwards et al. | 52/749.11 |

(Continued)

*Primary Examiner*—Richard E Chilcot, Jr.
*Assistant Examiner*—Anthony N Bartosik
(74) *Attorney, Agent, or Firm*—Darby & Darby PC; Robert J. Sacco

(57) ABSTRACT

Tool for efficiently hanging a siding plank on a wall in overlapping relation to a previously attached siding plank. The tool can be secured to a siding plank previously attached to a wall without using a hook that extends behind the previously attached siding plank. These features make the tool more convenient to use and allow the siding job to proceed more quickly. The tool is formed from an elongated base member. A first lip and a second lip project a predetermined distance from the same side of the elongated base member at opposing first and second ends thereof. A shelf or ledge is also provided on the elongated base member.

19 Claims, 5 Drawing Sheets

U.S. PATENT DOCUMENTS

| | | | | |
|---|---|---|---|---|
| 7,185,443 | B2 * | 3/2007 | Penhale | 33/649 |
| 2001/0034952 | A1 * | 11/2001 | Mansfield | 33/647 |
| 2003/0014877 | A1 | 1/2003 | Nadal et al. | |
| 2004/0221467 | A1 | 11/2004 | Chillington | |
| 2004/0244214 | A1 | 12/2004 | Just | |
| 2006/0010828 | A1 * | 1/2006 | Tomczak | 52/749.11 |

* cited by examiner

SIDING TOOL

BACKGROUND OF THE INVENTION

1. Statement of the Technical Field

The inventive arrangements relate to tools for installing siding on a building construction, and more particularly to installing lapped siding.

2. Description of the Related Art

Installation of siding planks for a building construction can be difficult and tedious work. Siding planks are typically installed from the bottom of the structure to the top. Each succeeding planks in typically installed on a wall lapped to a predetermined extent over a previously installed plank. However, it can be difficult to align succeeding planks with the previously installed planks. Further, it can be difficult to ensure that each succeeding plank is properly lapped over previously installed planks. Excessive amounts of overlapping as between adjacent planks can result in excessive numbers of planks being required to completely cover a wall with siding. Insufficient lapping can permit rain and moisture to penetrate the siding.

Various tools have been proposed to permit more efficient installation of siding planks. Examples of such tools are disclosed in U.S. Pat. Nos. 4,155,175; 4,159,029; 4,425,714; 4,862,669; 5,203,090; 5,319,909; 5,465,499; and 6,848,192. However, all of the currently available tools suffer from one of several limitations. These limitations relate in each case to the manner in which the tool is positioned while installing each plank. Some siding tools require the user to hold the tool in position while installing each plank. This is unsafe and inconvenient because it leaves the installer with only one hand free during the installation process or requires a second person. Another method for positioning the tool can involve nailing the tool to the wall during the installation of a siding plank, and subsequently prying the tool loose from the wall when the installation of the plank is complete or nearly complete. This process damages the face of the siding and the underlying weatherproof barrier. It is also time consuming and inefficient for the installer. A third method of positioning the tool involves hooks that extend around the back side of a previously installed plank. The hook used on such tools generally includes a portion that extends between the siding plank and the wall on which the siding is to be installed. This approach is an improvement over the other methods for positioning the siding plank. However, it remains problematic because the hook on the tool can easily become jammed between the plank and the wall. Once again, this positioning limitation can slow down the installation process. It can also result in uneven installation of the siding and damages the underlying weather-resistant barrier. Finally, the process is time consuming for the installer.

SUMMARY OF THE INVENTION

The invention concerns a tool for efficiently hanging a siding plank on a wall in overlapping relation to a previously attached siding plank. Furthermore, the tool can be secured to a siding plank previously attached to a wall without using a hook that extends behind the previously attached siding plank. These features make the tool more convenient to use and allow the siding job to proceed more quickly.

The tool is formed from an elongated base member. A first lip and a second lip project a predetermined distance from the same side of the elongated base member at opposing first and second ends thereof. The first and second lips are advantageously aligned in respective planes that are generally transverse to a plane defined by the elongated base member. Moreover, the first lip and the second lip can be spaced apart by a distance approximately equal to a width of a plank of siding.

A shelf or ledge is also provided on the elongated base member. The ledge projects from a second side of the elongated base member opposed from the first side. The ledge can be aligned in a plane generally transverse to a plane of the elongated base member. Moreover, the ledge can be sized and shaped for receiving an edge of a plank of siding. A handle can be provided projecting from the second side of the elongated base member.

With the tool arranged as described, the first lip, the second lip and the elongated base member together comprise a resilient clip. The resilient clip can frictionally engage a previously attached siding plank at opposing upper and lower edges thereof. More particularly, the first lip and the second lip can engage the upper and lower edges of the previously attached siding plank.

At least one of the first and second lips can be aligned with a plane that forms an acute angle relative to a plane defined by said elongated base member. For example, the first lip at an upper end of the tool can be angled slightly toward the lower lip to improve the gripping action of the first lip relative to a previously attached siding plank. The second lip on a lower end of the tool can be similarly angled slightly toward the upper lip. Alternatively, the second lip can be angled slightly away from the upper lip to form an obtuse angle with the elongated base member to facilitate attachment and removal of the clip from a previously attached siding plank.

According to one aspect of the invention, the tool can also include an adjustable structure for selectively controlling the spacing between the first lip and the second lip. In one such structure, the elongated base member can be formed of an upper and a lower element that are movable relative to one another. The movement of the upper and lower element can be used to change the spacing between the first lip and the second lip for resiliently engaging the edges of different sizes of siding planks. In this regard, a resilient element can be attached to the upper element and the lower element respectively. The resilient element can resiliently bias the first lip toward said second lip for enhancing the operation of the spring clip.

DETAILED DESCRIPTION OF THE PREFERRED EMBODIMENTS

Figure 1:
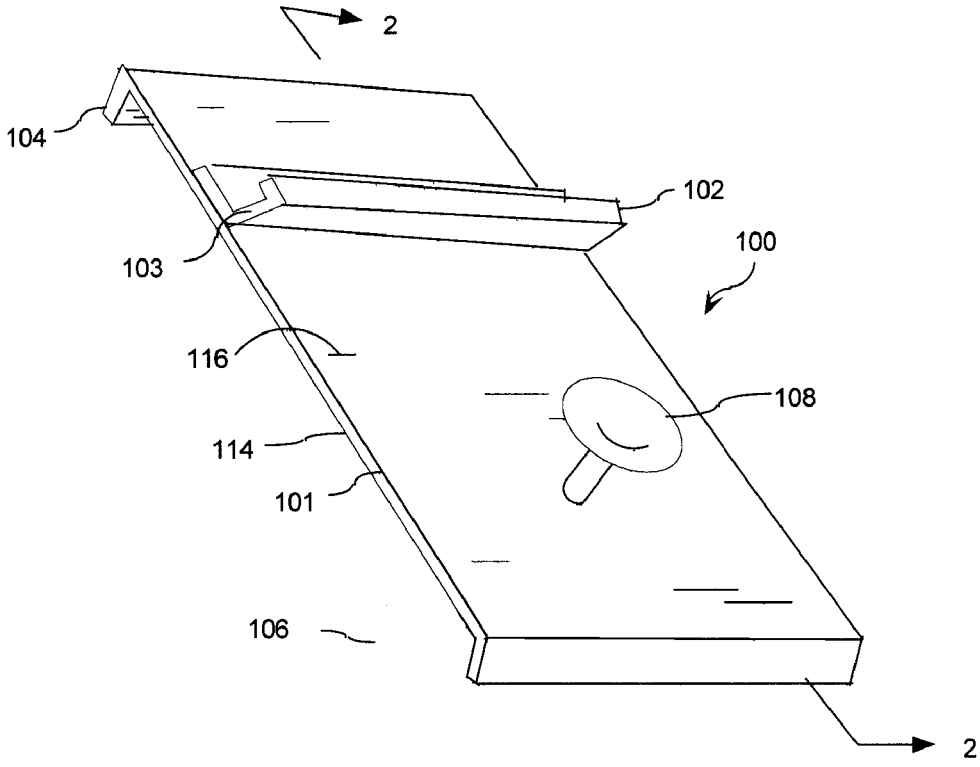
FIG. 1 is a perspective view of a siding tool that is useful for understanding the invention.
Figure 2:
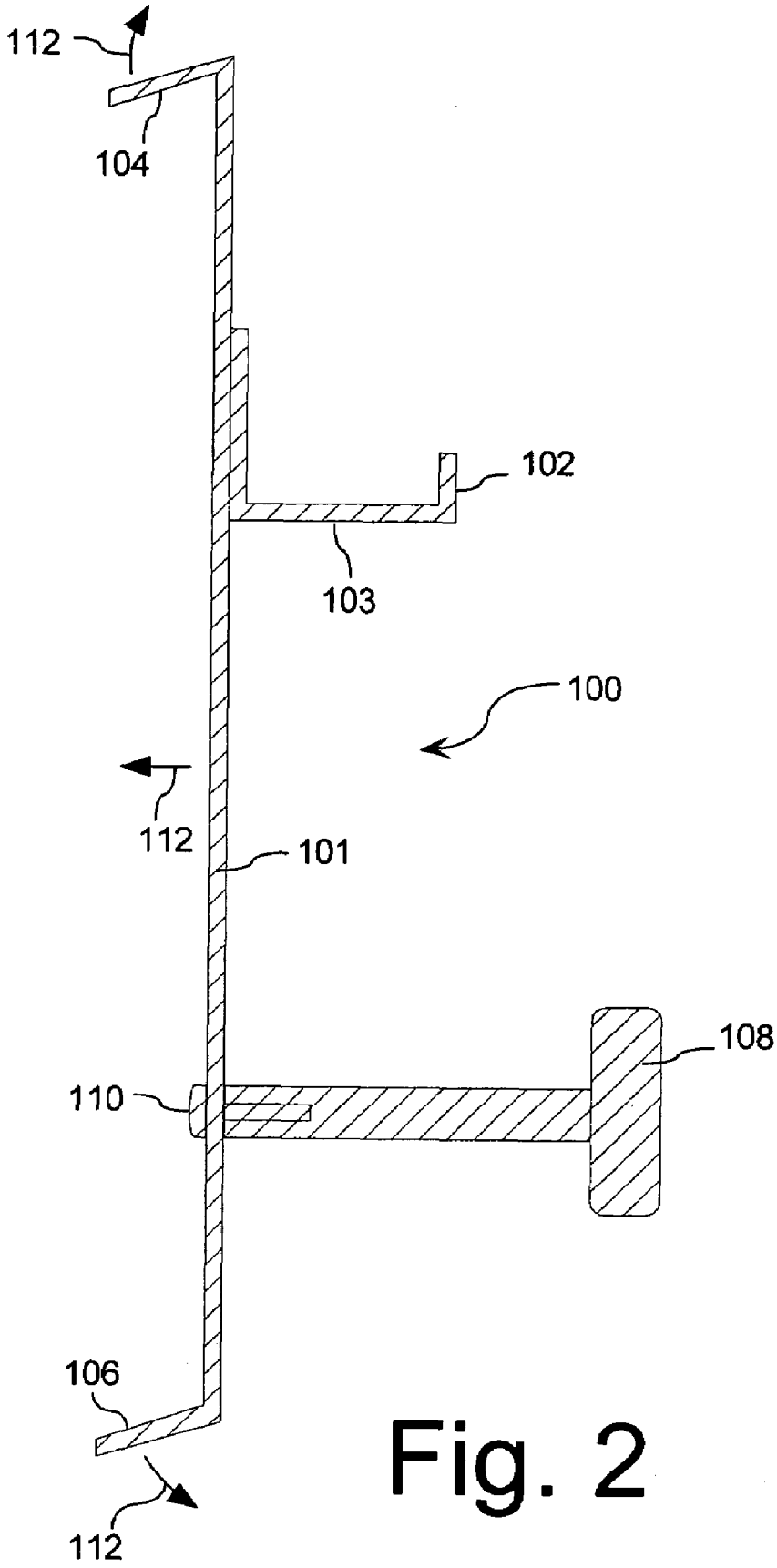
FIG. 2 is cross-sectional view of the siding tool in FIG. 1, taken along line 2-2.

A tool for efficiently hanging a siding plank on a wall in overlapping relation to a previously attached siding plank is shown in FIG. 1. The tool 100 can include an elongated base member 101. A first lip 104 and a second lip 106 project a predetermined distance from a side 114 of the elongated base member 101 at opposing first and second ends of the elongated base. As best seen in FIG. 2, the first and second lips 104, 106 are advantageously aligned in respective planes that are generally transverse to a plane defined by the elongated base member. Moreover, the first lip 104 and the second lip 106 can be advantageously spaced apart by a distance approximately equal to a width of a plank of siding.

Referring to FIGS. 1 and 2, a shelf or ledge 102 is also provided on the elongated base member 101. The ledge 102 projects from a second side 116 of the elongated base member 101 opposed from the side 114. As best seen in FIG. 2, the ledge 102 can be aligned in a plane generally transverse to a plane of the elongated base member. Moreover, the ledge 102 can be sized and shaped for receiving and temporarily supporting an edge of a plank of siding. A handle 108 can be provided projecting from the second side 116 of the elongated base member 101 for grasping the tool.

The elongated base member 101, the first lip 104, and the second lip 106 are advantageously formed of sheet metal, plastic or composite material. However, the invention is not limited in this regard and other materials can also be used. The material selected should advantageously offer some degree of spring or flex for reasons that will be better understood from the description below.

With the tool arranged as described in FIGS. 1 and 2, the first lip 104, the second lip 106 and/or the elongated base member 101 can comprise a resilient clip. In the embodiment shown in FIG. 2, these three elements can cooperate together to form the resilient clip. For example, the first lip 104, second lip 106, and the elongated base member can flex or resiliently deform slightly in the direction of arrows 112 shown in FIG. 2. The tool 100, operating as a spring clip, can frictionally engage a previously attached siding plank at opposing upper and lower edges thereof. More particularly, the first lip 104 and the second lip 106 can engage the upper and lower edges of a previously attached siding plank. The attachment of the tool to a plank and its use for installing additional siding planks will now be described in greater detail in relation to FIGS. 3-6.

Figure 3:
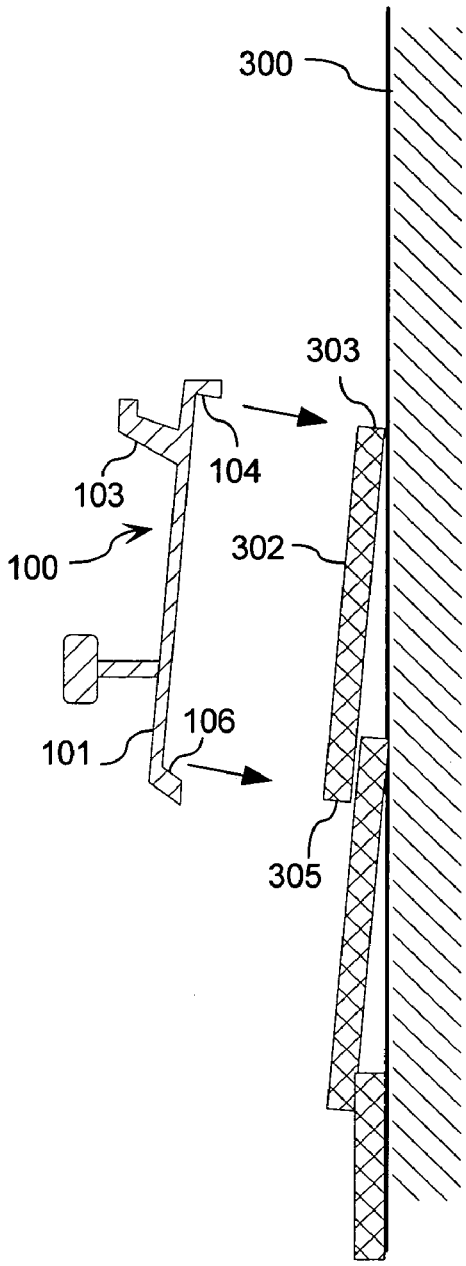
FIGS. 3-6 are a series of drawings that are useful for understanding how the siding tool in FIG. 1 can be used.
Figure 4:
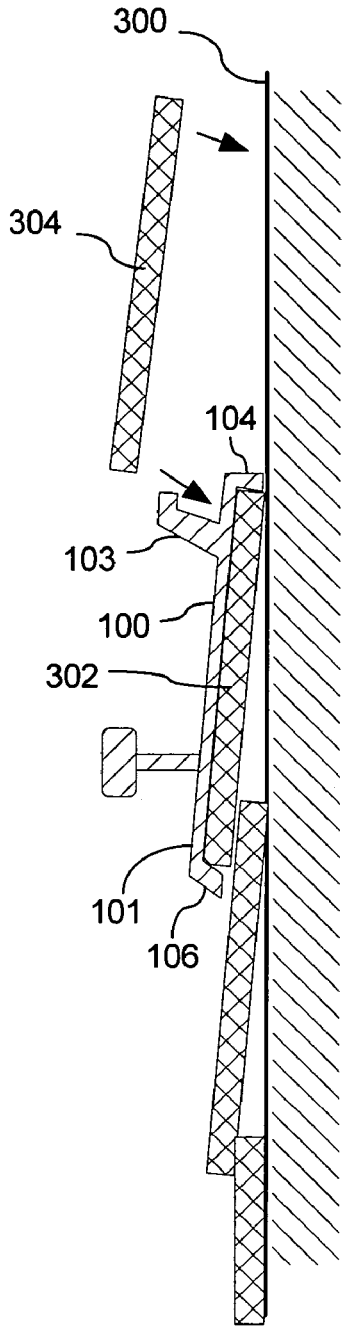

In FIG. 3 there is shown in cross-section a wall 300 on which siding planks are being installed. As shown in FIGS. 3 and 4, the tool 100 can be positioned on a previously installed siding plank 302. The first lip 104, the second lip 106, and the elongated base member 101 cooperate to frictionally engage the upper and lower edges 303, 305 of the previously installed siding plank 302. More particularly, the lips 104, 106 can flex slightly as the tool is pushed onto the plank, thereby providing a secure spring-like engagement with the edges of the plank. Alternatively, or in addition thereto, the elongated base member can resiliently flex to a limited extent as the lips 104, 106 are pushed over the edges 303, 305 of the previously installed siding plank 302. In this regard, it will be appreciated that the elongated engagement member can have a slight arc along its elongate length. Such an can improve the spring action of the tool as it allows the relative spacing between the first and second lips to change slightly as the tool is positioned on a previously installed siding plank 302.

Figure 5:
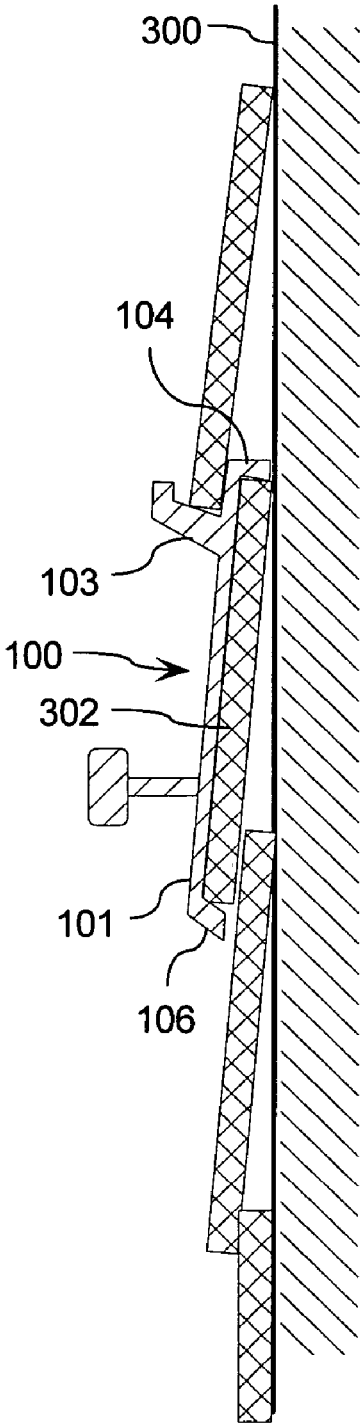
Figure 6:
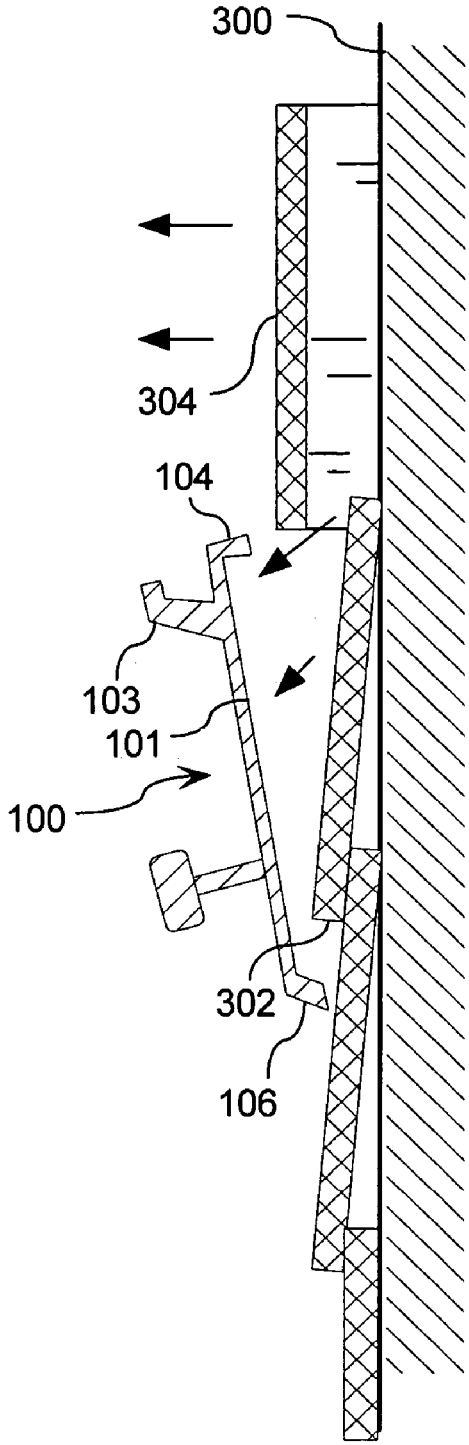

Once the tool 100 is positioned as described, a siding plank 304, which is to be installed, can be positioned on ledge 103. This step is best observed in FIGS. 4 and 5. FIG. 4 shows the siding plank being moved to position and FIG. 5 shows the siding plank 304 positioned on the ledge 103. Once the siding plank 304 is in position as shown in FIG. 5, conventional means can be used for partially securing the siding plank 304 to the wall. Typically, such installations will involve the use of metal nails, screws or adhesives. However, after the plank 304 is at least partially installed, and prior to securing to wall 300 that portion of the plank where it is supported by tool 100, the tool 100 can be slipped off of the previously installed siding plank 302. Once the tool is removed, nails, screws or other securing means can be used to attach the remaining portions of the siding plank 304. The foregoing process can be repeated until all of the siding planks are installed.

Notably, in FIGS. 3-6 the installation of siding planks using the tool 100 is described using only a single tool. However, it should be understood that that two or more tools 100 can be used to support each siding plank as it is installed. Further, it may be observed in FIGS. 3-6 that the first lip 104 and the second lip 106 extend a predetermined distance from the elongated base member. The precise distance the lips extend from the elongated base member is not critical. However, it can be advantageous for this distance to roughly correspond to the thickness of the plank. Alternatively the lip can extend somewhat less than the thickness of the plank. In any case, it is advantageous to limit the length of the lips 104, 106 so they do not protrude beyond the thickness of the plank 302 when the tool 100 is positioned thereon. Further, it may be noted that the lips advantageously do not have any hook portion that would extend between a plank of siding 302 and wall 300. With the lips 104, 106 configured as described herein, the tool 100 can be easily removed after each plank installation.

Referring to FIG. 2 again, it can be observed that at least one of the first and second lips can be aligned with a plane that forms an acute angle relative to a plane defined by said elongated base member. For example, the first lip 104 at an upper end of the tool can be angled slightly toward the lower lip 106. This angle can advantageously improve the gripping action of the first lip relative to a previously attached siding plank 302. The second lip 106 on a lower end of the tool 100 can be similarly angled slightly toward the upper lip. Alternatively, the second lip can be angled slightly away from the upper lip as shown in FIG. 2 to form an obtuse angle with respect to the elongated base member 101. Such an angle can facilitate attachment and removal of the clip from a previously attached siding plank, although it provides a slightly less secure engagement.

In FIG. 2, it may also be noted that the elongated base member 101 is shown as essentially a planar element. However, it should be understood that the invention is not limited in this regard. The elongated base member can have a slight arc or bow (not shown) along its elongated lengths. Such an arc can facilitate the spring action of the elongated base member 101.

Figure 7:
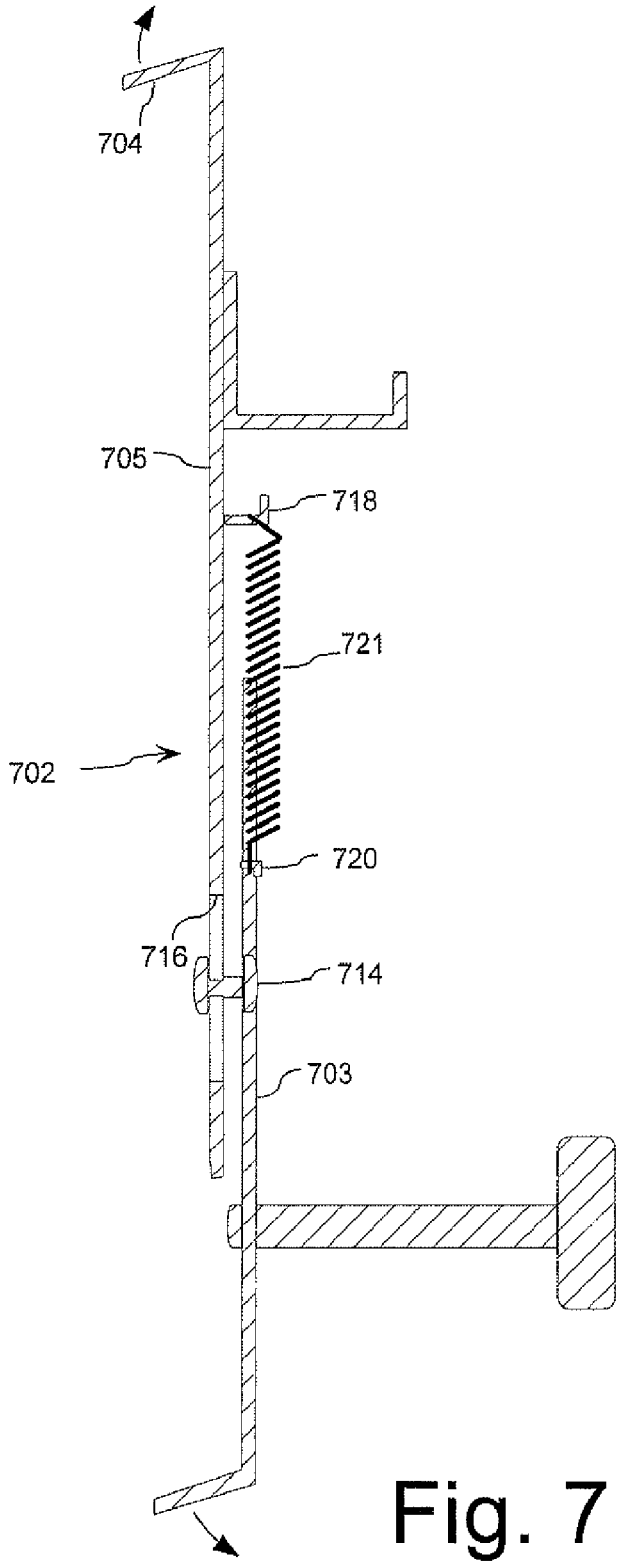
FIG. 7 is a cross-sectional view of alternative embodiment of a siding tool that is useful for understanding the invention.

According to one aspect of the invention, a siding tool in accordance with the inventive arrangements can also include an adjustable structure for selectively controlling the spacing between the first lip and the second lip. FIG. 7 shows one such structure in which an elongated base member 702 is formed of an upper element 705 and a lower element 703 that are movable relative to one another. In FIG. 7, the upper element 705 and the lower element 703 slide relative to one another by means of a post and slot arrangement. More particularly, a post 714 secured to lower element 703 can slide within a slot 716 defined in the upper element 705. Two or more such slot elements can be used to maintain the alignment of the upper and lower elements. Of course, there are many other ways that the upper and lower elements can be constructed to move in a sliding alignment with one another and the invention is not intended to be limited to the particular adjustment structures shown.

In FIG. 7, a resilient element 721 can be provided attached to the upper and lower elements 705, 703 by means of hook members 718, 720. The resilient element can be an elastic band, a coil spring or any other type of resilient device capable of biasing the upper element 705 toward the lower element 703. The movement of the upper and lower elements 703, 705 relative to one another can be used to change the spacing between the first lip 704 and the second lip 706 for resiliently engaging the edges of different sizes of siding planks. The resilient element 721 can resiliently bias the first lip 704 toward the second lip 706 for enhancing the spring clip operation of the tool.

While the foregoing description is directed to the preferred embodiment of the present invention, other and further embodiments of the invention may be devised without departing from the basic scope thereof. Accordingly, the scope of the present invention should be determined by the claims that follow.

We claim:

1. A tool for efficiently hanging siding planks on a wall in overlapping relation to a previously attached siding plank, comprising:

an elongated base member;

a first lip and a second lip projecting a predetermined distance in a first direction from a first side of said elongated base member at opposing first and second ends thereof, said first and second lips aligned in respective planes that are generally transverse to a plane defined by said elongated base member; and a support structure located on a second side opposed from said first side of said elongated base member and configured with a size and shape for receiving and retaining an edge of a plank of siding, said support structure comprising a surface parallel to said elongated base member and a ledge transversely projecting from said surface and away from said first and second lips, said support structure located a predetermined distance between said first and second ends of said elongated base member.

2. The tool according to claim 1, wherein said first lip and said second lip are respectively formed as planar strips.

3. The tool according to claim 1, wherein said elongated base member defines an arc extending between said first and second ends to form a spring, and wherein said first lip, said second lip and said elongated base member together comprise a spring clip for resiliently engaging a previously attached siding plank at opposing upper and lower edges thereof.

4. The tool according to claim 1, wherein said tool further comprises a means for selectively controlling a spacing between said first lip and said second lip.

5. The tool according to claim 1, further comprising a handle projecting from said second side of said elongated base member.

6. The tool according to claim 1, wherein said first lip forms an acute angle with said first side of said elongated base member so that it is angled toward said second lip and said second lips forms an acute angle with said first side of said elongated base member so that it is angled towards said first lip.

7. The tool according to claim 1, wherein said first lip forms an acute angle with said first side of said elongated base member so that it is angled toward said second lip and said second lips forms an obtuse angle with said first side of said elongated base member so that it is angled away from said first lip.

8. A tool for efficiently hanging siding planks on a wall in overlapping relation to a previously attached siding plank, comprising:

an elongated base member;

a first lip and a second lip projecting a predetermined distance in a first direction from a first side of said elongated base member at opposing first and second end portions thereof, said first and second lips aligned in respective planes that are generally transverse to a plane defined by said elongated base member; and a support structure located on a second side opposed from said first side of said elongated base member and configured with a size and shape for receiving and retaining an edge of a plank of siding, said support structure comprising a surface parallel to said elongated base member and a ledge transversely projecting from said surface and away from said first and second lips, said support structure located a predetermined distance between said first and second end portions of said elongated base member;

wherein said first lip, said second lip and said elongated base member together comprise a resilient spring clip for frictionally engaging a previously attached siding plank at opposing upper and lower edges thereof.

9. The tool according to claim 8, wherein said tool further comprises means for selectively controlling a spacing between said first lip and said second lip.

10. The tool according to claim 8, further comprising a handle projecting from said second side of said elongated base member.

11. The tool according to claim 8, wherein said first lip forms an acute angle with said first side of said elongated base member so that it is angled toward said second lip and said second lips forms an acute angle with said first side of said elongated base member so that it is angled toward said first lip.

12. The tool according to claim 8, wherein said first lip forms an acute angle with said first side of said elongated base member so that it is angled toward said second lip and said second lips forms an obtuse angle with said first side of said elongated base member so that it is angled away from said first lip.

13. The tool according to claim 8, wherein said elongated base member is comprised of an upper and a lower element that are movable relative to one another for changing a spacing between said first lip and said second lip.

14. The tool according to claim 8, wherein said elongated base member defines an arc extending between said first and second end portions to form a spring.

15. A tool for efficiently hanging siding planks on a wall in overlapping relation to a previously attached siding plank, without the need for nailing the tool to the wall, comprising:

an elongated base member;

a first lip and a second lip projecting a predetermined distance from a same side of said elongated base member at opposing first and second portions thereof, said first and second lips aligned in respective planes that are generally transverse to a plane defined by said elongated base member;

a ledge generally projecting from a second side of said elongated base member and aligned in a plane generally transverse to said plane of said elongated base member, said ledge sized and shaped for receiving an edge of a plank of siding; and a resilient element attached to said upper element and said lower element respectively, said resilient element resiliently biasing said first lip toward said second lip;

wherein said first lip, said second lip and said elongated base member together comprise a resilient spring clip for frictionally engaging a previously attached siding plank at opposing upper and lower edges thereof, and said elongated base member is comprised of an upper and a lower element that are movable relative to one another for changing a spacing between said first lip and said second lip.

16. A tool for efficiently hanging siding planks on a wall in overlapping relation to a previously attached siding plank, comprising:

an elongated base member;

a first lip and a second lip formed as substantially planar strips projecting a predetermined distance in a first direction from a first side of said elongated base member at opposing first and second end portions thereof, said first and second lips aligned in respective planes that are generally transverse to a plane defined by said elongated base member; and a support structure located on a second side opposed from said first side of said elongated base member and configured with a size and shape for receiving and retaining an edge of a plank of siding, said support structure comprising a surface parallel to said elongated base member and a ledge transversely projecting from said surface and away from said first and second lips, said support structure located a predetermined distance between said first and second end portions of said elongated base member;

wherein said elongated base member defines an arc extending between said first and second end portions to form a spring, and said first lip, said second lip and said elongated base member together comprise a resilient spring clip for frictionally engaging a previously attached siding plank at opposing upper and lower edges thereof.

17. The tool according to claim 16, wherein said tool further comprises a means for selectively controlling a spacing between said first lip and said second lip.

18. The tool according to claim 16, further comprising a handle projecting from said second side of said elongated base member.

19. The tool according to claim 16, wherein said first lip forms an acute angle with said first side of said elongated base member so that it is angled toward said second lip and said second lip forms an obtuse angle with said first side of said elongated base member so that it is angled away from said first lip.

* * * * *